US005400625A

United States Patent [19]

Embry

[11] Patent Number: 5,400,625

[45] Date of Patent: Mar. 28, 1995

[54] LOCKING KEY RING

[76] Inventor: Donald J. Embry, P.O. Box 144, Cloverport, Ky. 40111

[21] Appl. No.: 161,078

[22] Filed: Dec. 3, 1993

Related U.S. Application Data

[63] Continuation of Ser. No. 5,435, Jan. 19, 1993, abandoned.

[51] Int. Cl.[6] ..... A44B 15/00

[52] U.S. Cl. ..... 70/38 A; 70/456 R; 70/459; 70/460; 40/634

[58] Field of Search ..... 70/20, 35, 38 R, 38 A, 70/38 B, 38 C, 39, 460, 456 R–459; 24/3 K; 40/634

[56] References Cited

U.S. PATENT DOCUMENTS

| | | | |
|---|---|---|---|
| 292,954 | 2/1884 | Russell | 40/634 |
| 844,412 | 2/1907 | Schroeder | 70/39 |
| 1,902,665 | 3/1933 | Reinhold | 70/39 |
| 2,374,669 | 5/1945 | DeQuick | 70/38 A |
| 2,683,979 | 10/1950 | Stageberg | 70/459 |
| 3,475,933 | 3/1968 | Kobrehel | 70/364 |
| 3,589,155 | 6/1971 | Kamp | 70/459 |
| 3,605,458 | 9/1971 | Best | 70/49 |
| 3,704,605 | 12/1972 | Leopoldi et al. | 70/456 R |
| 3,728,879 | 4/1973 | Best | 70/49 X |
| 3,736,781 | 6/1973 | Foote | 70/456 R |
| 3,956,913 | 5/1976 | Howard | 70/456 R |
| 4,281,527 | 8/1981 | Leopoldi et al. | 70/456 R |
| 4,358,944 | 11/1982 | Stoffel | 70/457 |
| 4,823,566 | 4/1989 | Patton | 70/39 X |
| 5,148,690 | 9/1992 | Wang | 70/38 A |
| 5,180,192 | 1/1993 | Herbert | 40/634 X |
| 5,186,029 | 2/1993 | Myers | 70/38 A |

FOREIGN PATENT DOCUMENTS

| | | | |
|---|---|---|---|
| 505407 | 7/1920 | France | 70/20 |
| 1497341 | 8/1967 | France | 70/185 |

*Primary Examiner*—Peter M. Cuomo
*Assistant Examiner*—Suzanne L. Dino
*Attorney, Agent, or Firm*—Richard C. Litman

[57] ABSTRACT

A locking key ring for supporting keys and for preventing the unauthorized removal and duplication of the keys. The locking key ring carries identification and instructions to contact the identified party prior to copying the keys thereby reducing the risk of unauthorized duplication. The locking key ring comprises a cylinder lock assembly adapted to receive a shackle in the form of a key ring. Removal of the keys from the key ring is not permitted unless the lock cylinder releases the key ring. This is accomplished through use of an operating key which matingly engages the lock cylinder. The cylinder housing carries identifying inscription and instructions for a locksmith to receive authorization prior to making copies of the keys.

14 Claims, 3 Drawing Sheets

LOCKING KEY RING

Cross-REFERENCE TO RELATED APPLICATION

This application is a continuation of application Ser. No. 08/005,435, filed on Jan. 19, 1993, now abandoned.

BACKGROUND OF THE INVENTION

1. Field of the Invention

The present invention relates generally to locks and more particularly, to a locking key ring comprising a cylinder lock and a shackle in the form of a key ring for supporting keys.

2. Description of the Prior Art

Locks generally prevent or limit access or entry. Access is permitted by those whose possess a key which mates with the lock guarding the premisses or preventing access. Through the use of locks and keys, access or entry may be limited to select or chosen individuals. The keys are typically issued or entrusted to persons on a temporary basis or for an indefinite period. When the period terminates, such as at the end of a term of employment or a lease, the keys are relinquished by the person entrusted and the access thereby terminated. A problem associated with keys is that copies may be made without authorization and the copies may not be forfeited along with the original keys rendering potential access or entry to unauthorized individuals. One solution to this problem would include providing a means to discourage or eliminate the unauthorized reproduction of keys. One way to discourage the unauthorized duplication of keys is to provide a lock device, such as a locking key ring which has a warning label to contact a certain authority prior to copying keys. Key rings are well known in the prior art. One common type of key ring is shown, for example, in U.S. Pat. No. 3,956,913 issued May 18, 1976 to R. W. Howard. Howard describes a key ring comprising a body having an opening to receive a U-shaped ring clip. The U-shaped ring clip facilitates in supporting one or more keys. Upon a cursory examination of U.S. Pat. No. 2,683,979 issued Jul. 20, 1954 to W. E. Stageberg, one may conclude that a locking key ring exists which would prevent the unauthorized removal of keys. However, the lock shown is quite a primitive lock and, would offer little resistance to being picked and then relocked after keys were copied and the originals were placed back on the shackle. Further, no warning is shown which would encourage a locksmith to notify the proper authorities prior to duplicating the keys. An alternative key holder is shown in U.S. Pat. No. 3,736,781 issued Jun. 5, 1973 to D. J. Foote who describes a simulated padlock characterized by a double-ended shackle, each shackle being purposed for supporting one or more keys. This key holder appears to be bulky and therefore, may be uncomfortable to carry on one's person. A smaller lock, such as a cylinder lock assembly, may be more practical. However, no such locking key ring is known to exist.

Applicant proposes a locking key ring which comprises a lock cylinder assembly and a shackle or a key ring for supporting one or more keys. The cylinder housing would carry indicia indicating an authority to be contacted for authorization prior to duplicating keys. None of the above inventions and patents, taken either singly or in combination, is seen to describe the instant invention as claimed.

SUMMARY OF THE INVENTION

The present invention relates to a locking key ring for supporting keys and for preventing the unauthorized removal of the keys. The locking key ring carries identification and instructions to contact the identified party prior to copying the keys thereby reducing the risk of unauthorized duplication. The locking key ring comprises a cylinder lock assembly adapted to receive a shackle in the form of a key ring. Removal of the keys from the key ring is not permitted unless the lock cylinder releases the key ring. This is accomplished through use of a limited access key which matingly engages the lock cylinder. The cylinder housing carries identifying inscription such as an individual and/or company name, an address, and a telephone number, and instructions for a locksmith to receive authorization prior to making copies of the keys.

Accordingly, it is a principal object of the invention to provide a locking key ring for supporting keys and for preventing the unauthorized removal of the keys.

It is another object to provide a locking key ring carries identification and instructions to contact the identified party prior to copying the keys thereby reducing the risk of unauthorized duplication.

It is a further object to provide a locking key ring comprising a cylinder lock assembly adapted to receive a shackle in the form of a key ring.

Still another object is to provide a key ring wherein the removal of the keys therefrom is not permitted unless the lock cylinder releases the key ring. This is accomplished through use of a limited access key which matingly engages the lock cylinder.

Yet another object is to provide a cylinder housing which carries identifying inscription such as an individual and/or company name, an address, and a telephone number, and instructions for a locksmith to receive authorization prior to making copies of the keys.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
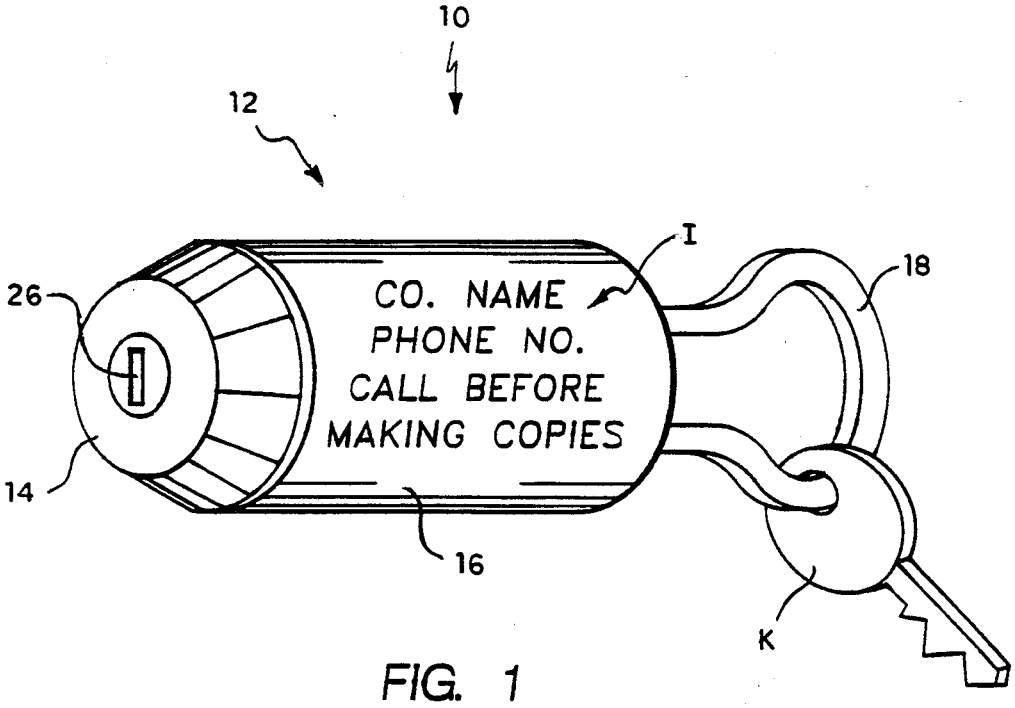
FIG. 1 is an environmental front perspective of the locking key ring.

The present invention as shown in FIG. 1 is a locking key ring 10 comprising a quarter turn lock cylinder assembly 12 including a cam lock 14 and a housing 16, and a shackle 18 in the form of a key ring for supporting one or more keys K. The housing 16 preferably carries identifying and instructional data in the form of indicia I. The identifying information could include a company or an individual's name, an address, and a phone number. The instructional information would inform a locksmith to notify an authority prior to duplicating the key or keys K.

Figure 2:
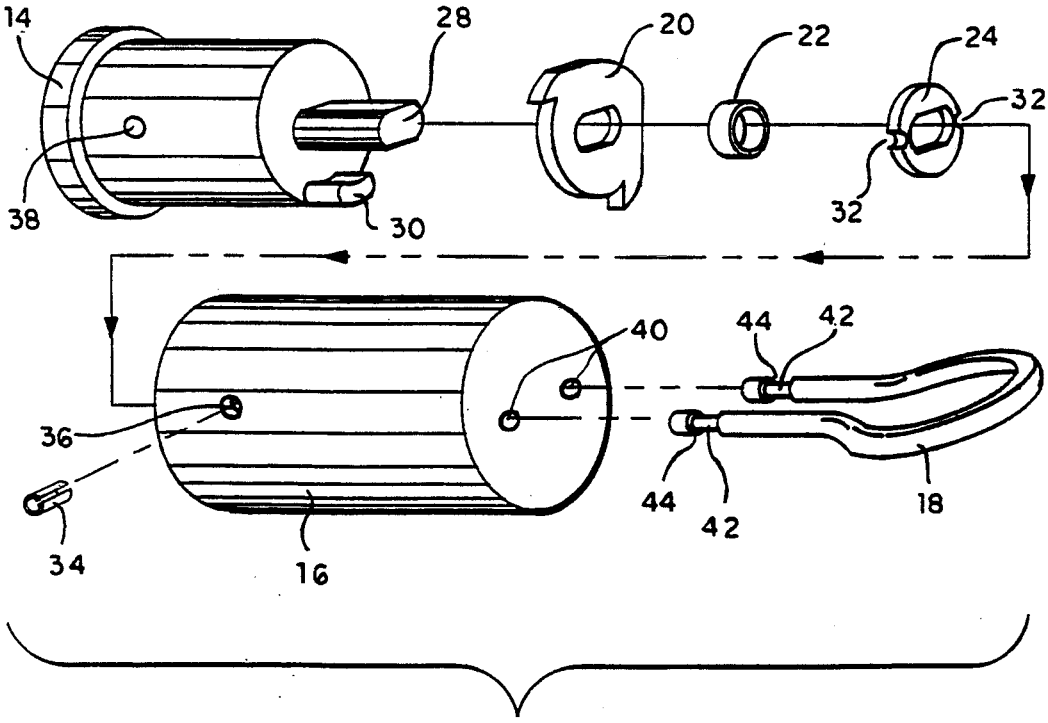
FIG. 2 is an exploded rear perspective view of the locking key ring shown in FIG. 1.

FIG. 2 shows the locking key ring 10 further comprising an irregular shaped ninety degree turn stop 20, a cylindrical bushing 22, and a circular locking cam 24. The cam lock 14, as shown in FIG. 1, has a key hole 26 disposed at a proximal end thereof and a tail shaft 28 (in the form of a double-D shaft) extending from a distal end. The tail shaft 28 carries the ninety degree turn stop 20, the bushing 22, and the locking cam 24. The turn stop 20 and the locking cam 24 are each provided with an aperture which matingly engages the tail shaft 28. Without the presence of the turn stop 20, the operating key (not shown) could rotate the tail shaft 28 indefinitely. The turn stop 20 functions in cooperation with a protrusion 30 extending from a lower rear portion of the cam lock 14. It is this cooperative relationship which limits the rotational travel of the tail shaft 28 to ninety degrees or one quarter turn. The bushing 22 disposed between the turn stop 20 and the locking cam 24 provides a desired spatial separation between the turn stop 20 and the locking cam 24. The locking cam 24 includes two semi-circular notches 32 disposed 180 degrees apart about the outer periphery thereof. The housing 16 contains the cam lock 14, the turn stop 20, the bushing 22 and the locking cam 24. A pin 34 is engagable with a hole 36 in the housing 16 and a hole 38 in the cam lock 14 which coaligns with a hole 36 in the housing 16. The pin 34 maintains the cam lock 14 in a position relative to the housing 16 retaining the cam lock 14, the turn stop 20, the bushing 22 and the locking cam 24 therein. Two openings 40 are located at the rear of the housing 16 which are purposed to receive end portions of the shackle 18. The shackle 18 is substantially U-shaped and the end portions thereof each include a reduced diameter end portion 42 and an intermediate shoulder 44.

Figure 3:
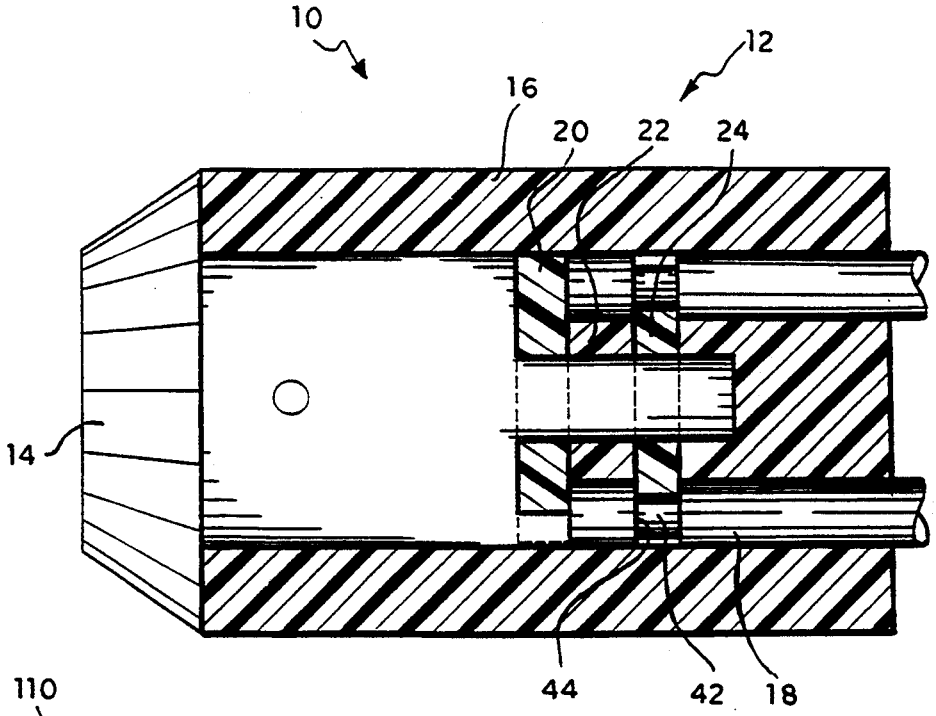
FIG. 3 is a partial cross sectional view of the locking key ring shown in FIG. 1.

Referring now to FIGS. 2 and 3, and more specifically to FIG. 3 showing the relationship between the shackle 18 and the locking cam 24. Interiorly of the rear end of the housing is 16 disposed a blind hole 46 to accommodate the distal end of the tail shaft 28. The space provided between the rear interior surface of the housing 16 and the rear surface of the cam lock 14 provides a loose fit for the turn stop 20, the bushing 22 and the locking cam 24 disposed therebetween.

The locking key ring 10 is shown in a locked position with the ninety degree turn stop 20 rotated fully clockwise and the locking cam 24 engaging the reduced diameter end portion 42 of the shackle or key ring 18. The washer 22 maintains the locking cam 24 in a spaced apart relation relative to the ninety degree turn stop 20. In this position, the shackle 18 is not removable from the rear of the housing 16. The housing 16 is fixed relative to the cam lock 24 preventing the shackle 18 and the housing 16 alike from being rotated to release the shackle 18. By turning the cam lock 14 counter clockwise ninety degrees rotating the tail shaft 28 and, in turn, the ninety degree turn stop 20 and locking cam 24, the semi-circular openings 32 are aligned with the end portions of the shackle 18 permitting the shackle 18 to be released from the rear of the housing 16.

Figure 4:
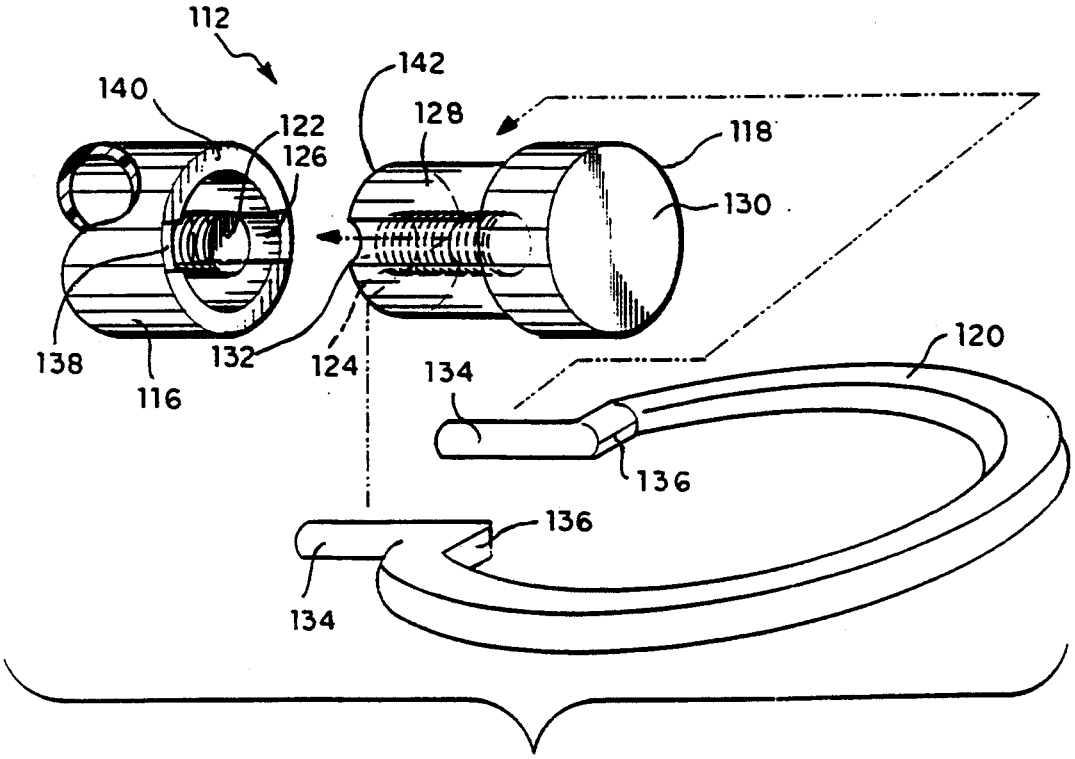
FIG. 4 is a partial exploded view of an alternative locking key ring.
Figure 5:
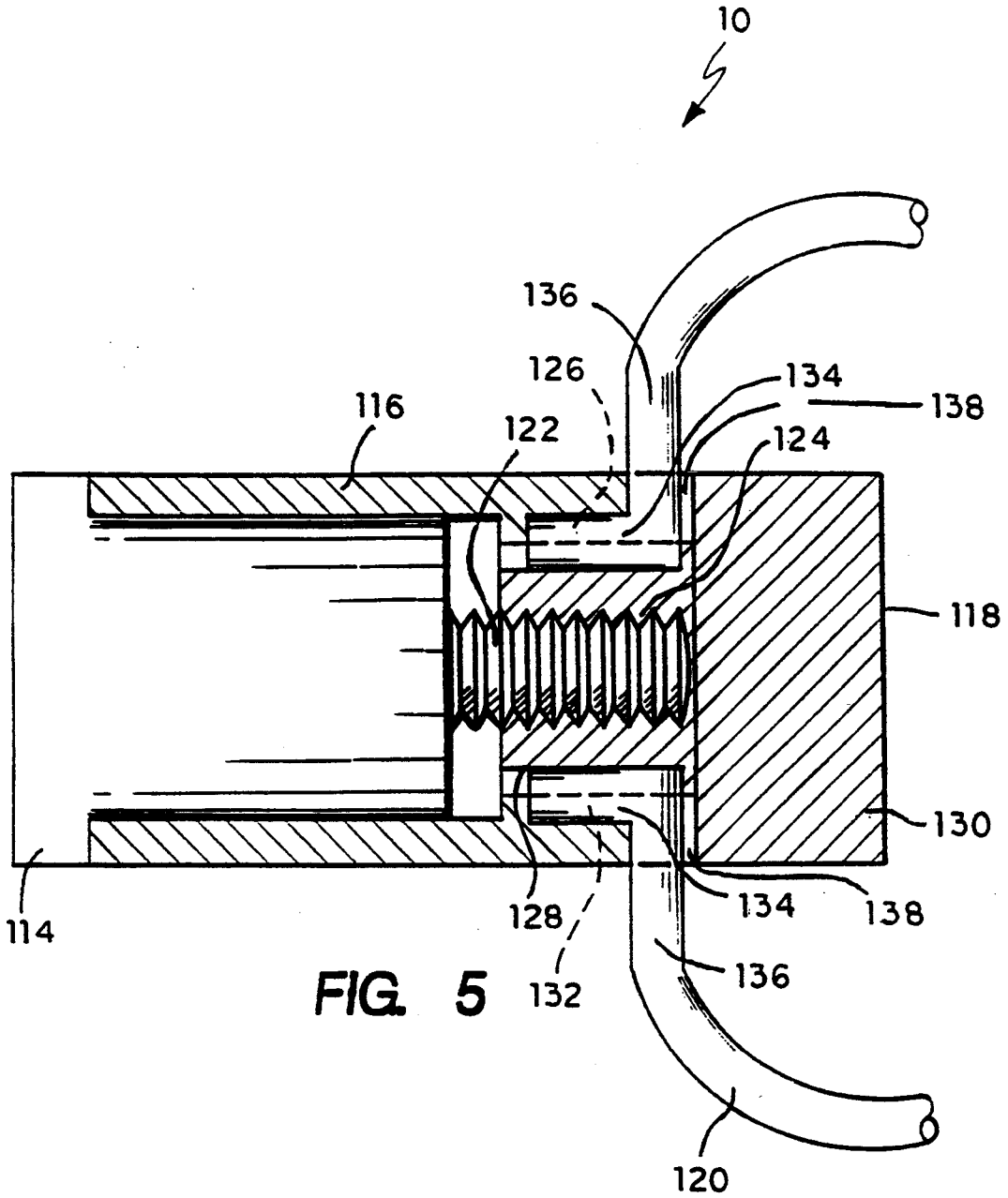
FIG. 5 is a partial cross sectional view of the locking key ring shown in FIG. 4.

FIGS. 4 and 5 show an alternative locking key ring 110 comprising a lock assembly 112 including a cam lock 114, a housing 116 and a rear housing plug 118, and a shackle or a key ring 120. The tail shaft 122 extending from the rear of the cam lock 114 is provided with a male thread which is threadably engagable with a female threaded aperture 124 centrally located in a forward portion of the rear housing plug 118. Elongated concave slots 126 are provided within the inner peripheral walls of the housing 116 and are spaced one hundred and eighty degrees apart. The rear housing plug 118 has a reduced diameter surface 128 and a head 130. Similar to the housing 116, the reduced diameter surface 128 also has elongated concave slots 132 spaced one hundred and eighty degrees apart and which mutually align with respective elongated slots 126 located interiorly of the housing 116. These slots 126,132 mutually align to form an elongated circular opening. The shackle 120 is substantially U-shaped and has substantially circular end portions 134 which are each engagable with a respective circular opening form by respective concave slots 126,132. Each end portion 134 of the shackle 120 further includes an offset segment 136. Notches 138 are provided in the rear shoulder 140 of the housing 116 adjacent the rear extremity of the elongated slot 126. According to this embodiment, with an operating key (not shown), the tail shaft 122 may be rotated clockwise or counter clockwise indefinitely. To lock the shackle 120 in the locked position shown in FIG. 5, the circular end portions 134 of the shackle 120 are inserted into the housing 116 and so as to engage the concave slots 126 therein. The aperture 124 in the plug 118 is aligned with the threaded tail shaft 122 while at the same time, the concave slots 132 associated with the plug 118 are aligned with both the circular end portions 134 and the concave slots 126 disposed interiorly of the housing 116 alike. As the tail shaft 122 is rotated clockwise, the plug 118 is drawn into the housing 116 until the shoulder 142 of the head 130 contacts the shoulder 140 of the housing 116. With the tail shaft 122 fully engaging the aperture 124 in the plug 118, the shackle 120 is intact. The circular end portions 134 occupy the circular openings defined by the mutually corresponding concave slots and the offset segments 136 each extend through the notches 138. With the circular end portions 134 occupying the circular openings, the plug 118 remains fixed relative to the housing 116 and similar to the first embodiment, the housing 116 remains fixed relative to the cam lock 114 by a pin 144 mutually engagable with the housing 116 and the cam lock 114. To disengage the shackle 120, simply rotate the operating key counter clockwise which, in turn, rotates the tail shaft 122 counter clockwise causing the tail shaft 122 to disengage the aperture 124 further causing the plug 118 to egress from the housing 116.

It should be noted that the principle of the underlying invention remains irregardless of the materials and the particular configurations shown. The material used in fabricating the locking key rings 10,110 is not limited to a particular material and the configuration may be arranged in any suitable manner to produced the instant invention as claimed. The present invention is not limited to the embodiments described above, but encompasses any and all embodiments within the scope of the following claims.

I claim:

1. A locking key ring for supporting one or more keys comprising:

a lock cylinder assembly; and a shackle including means for supporting the keys, said shackle being detachably engageable with said lock cylinder assembly, said shackle having first and second reduced diameter end portions, said first reduced diameter end portion defining a first circumferential groove and said second reduced diameter end portion defining a second circumferential groove;

said lock cylinder assembly comprising at least:

a cam lock, a locking cam supported by said cam lock, said locking cam configured as a monolithic plate and defining a pair of spaced apart notches therein, said locking cam simultaneously contacting said first circumferential groove and said second circumferential groove, when said cam lock is operated to a first state, said locking cam arranged so said notches align with said end portions and said shackle is removed from said lock cylinder assembly when said cam lock is operated to a second state, a housing for accommodating therein said cam lock and said locking cam, wherein said shackle is a U-shaped member having a circular cross-section and said reduced diameter end portion has a circular cross-section, each of said notches defining semi-circular opening in said locking cam and having a diameter slightly greater than a diameter of said reduced diameter end portion.

2. The locking key ring according to claim 1, wherein said housing of said lock cylinder assembly includes indicia whereby said indicia instructs an individual who attempts to copy the key supported by said locking key ring to obtain a preauthorization.

3. The locking key ring according to claim according to claim 1, wherein each of said reduced diameter end portions is substantially the same length.

4. The locking key ring according to claim according to claim 1, further comprising a key connected to said means for supporting the keys.

5. A locking key ring for supporting one or more keys comprising:

a lock cylinder assembly; and a shackle including means for supporting the keys, said shackle being detachably engageable with said lock cylinder assembly, said shackle having first and second reduced diameter end portions, said first reduced diameter end portion defining a first circumferential groove and said second reduced diameter end portion defining a second circumferential groove;

said lock cylinder assembly comprising at least:

a cam lock, a locking cam supported by said cam lock, said locking cam configured as a monolithic plate and defining a pair of spaced apart notches therein, said locking cam being operable by said cam lock to selectively engage said locking cam and said reduced diameter end portions of said shackle, when said cam lock is operated to a first state, and to align said notches with said shackle to detach said shackle from said lock cylinder assembly when said cam lock is operated to a second state, a housing for accommodating therein said cam lock and said locking cam, wherein said lock cylinder further includes a turn stop supported by said cam lock, said turn stop including a periphery and a cut out segment in said periphery providing opposingly disposed first and second abutments, and wherein said cam lock comprises at least:

a protrusion, fixed relative to said lock cylinder and located between said first abutment and said second abutment of said cut out in said turn stop so as to be engagable therewith, said protrusion restricting a rotation of said cam lock between the first position and the second position by being engagable with one of said first abutment and said second abutment, respectively.

6. The locking key according to claim 5, wherein said abutments of said cut out of said turn stop defines a rotational angle between the first position and the second position, said angle being ninety degrees.

7. The locking key ring according to claim according to claim 5, wherein each of said reduced diameter end portions is substantially the same length.

8. The locking key ring according to claim according to claim 5, further comprising a key connected to said means for supporting the keys.

9. A locking key ring for supporting one or more keys comprising:

a lock cylinder assembly; and a shackle including means for supporting the keys, said shackle having a pair of offset end portions detachably engageable with said lock cylinder assembly, said lock cylinder assembly comprising at least:

a cam lock having a threaded tail shaft extending therefrom, a housing for accommodating therein said cam lock, a housing plug engageable with said housing and defining a threaded aperture therein, said threaded shaft being threadably engageable with said threaded aperture to retain said housing plug in engagement with said housing, and said housing defining a pair of spaced apart elongated slots therein, each said slot having a concave cross section, said housing plug includes a reduced diameter surface and a head integral with said reduced diameter surface, said reduced diameter surface defining a pair of spaced apart elongated slots therein, each said slot having a concave cross section, said elongated slots in said housing mutually aligned with said elongated slots in said reduced diameter surface of said housing plug and defining a pair of spaced apart cylindrical openings for receiving said offset end portions of said shackle.

10. The locking key ring according to claim 9, wherein the concave cross section of said elongated slots in said inner peripheral wall of said housing and said elongated slots in said reduced diameter surface are each semi-circular in shape and said openings formed by the mutual alignment thereof are circular in cross section.

11. The locking key ring according to claim 9, wherein said elongated slots in said inner peripheral wall of said housing and said elongated slots in said reduced diameter surface are space one hundred and eighty degrees apart.

12. The locking key ring according to claim according to claim 9, wherein each of said offset end portions is substantially the same length.

13. The locking key ring according to claim according to claim 9, further comprising a key connected to said means for supporting the keys.

14. The locking key ring according to claim 9, wherein said housing of said lock cylinder assembly includes indicia whereby said indicia instructs an individual who attempts to copy the key supported by said locking key ring to obtain a preauthorization.

* * * * *